United States Patent [19]

Medlin et al.

[11] 4,378,845

[45] Apr. 5, 1983

[54] SAND CONTROL METHOD EMPLOYING SPECIAL HYDRAULIC FRACTURING TECHNIQUE

[75] Inventors: William L. Medlin, Dallas; Lynn D. Mullins, De Soto; Gary L. Zumwalt, Dallas, all of Tex.

[73] Assignee: Mobil Oil Corporation, New York, N.Y.

[21] Appl. No.: 221,478

[22] Filed: Dec. 30, 1980

[51] Int. Cl.[3] ..... E21B 43/04; E21B 43/119; E21B 43/267

[52] U.S. Cl. ..... 166/297; 166/278; 166/280; 166/308

[58] Field of Search ..... 166/280, 297, 298, 308, 166/278, 276, 55; 175/4.6, 4.51

[56] References Cited

U.S. PATENT DOCUMENTS

| | | | |
|---|---|---|---|
| 2,596,843 | 5/1952 | Farris | 166/308 U X |
| 2,950,247 | 8/1960 | McGuire, Jr. et al. | 166/280 |
| 3,075,581 | 1/1963 | Kern | 166/280 |
| 3,154,147 | 10/1964 | Lanmon | 175/4.51 |
| 3,175,617 | 3/1965 | North | 175/4.51 |
| 3,709,300 | 1/1973 | Pye | 166/280 |
| 3,712,379 | 1/1973 | Hill | 166/308 X |
| 3,896,877 | 7/1975 | Vogt, Jr. et al. | 166/280 X |
| 3,987,850 | 10/1976 | Fitch | 166/280 X |
| 4,245,702 | 1/1981 | Haafkens et al. | 166/280 X |

*Primary Examiner*—Stephen J. Novosad

*Attorney, Agent, or Firm*—Charles A. Huggett; Michael G. Gilman; George W. Hager

[57] ABSTRACT

A novel sand control method is disclosed wherein high viscosity, high sand concentration, fracturing fluids are pumped through sets of vertically oriented perforations in borehole casings located in unconsolidated or loosely consolidated pay zones. Various techniques are utilized to insure that sand fills disposed on either side of the borehole casing cover and substantially overlap each borehole casing perforation set. Procedures are then followed to bring the well into production without washing out the sand fills in these areas, whereby the resulting perforation-sand fill configurations effectively control sand production from the treated zone.

4 Claims, 1 Drawing Figure

SAND CONTROL METHOD EMPLOYING SPECIAL HYDRAULIC FRACTURING TECHNIQUE

BACKGROUND OF THE INVENTION

In oil well construction, problems may arise when a pay formation is an unconsolidated or loosely consolidated formation. In particular, during collection of fluids from the pay zone, problems may result from the inadvertent collection of sand, i.e. "sand production", in the fluid stream.

In order to limit sand production from unconsolidated formations, various methods may be employed for preventing formation sands from entering the production stream. Typically, "gravel packs" are utilized which comprise granular particles having diameters on the order of 4–13 times the formation grain size at the 10% coarse point on a cumulative sieve analysis. Such gravel packs are usually formed in the pay zone below terminations or interruptions in the borehole casing. Such gravel packs comprise a region of packed sand, the particles of which have selected diameters as described above, and a screen or perforated conduit which is utilized to aid in communicating fluids through the gravel or sand pack to unpacked regions of the borehole. Although such gravel packs are often successful at reducing sand production from unconsolidated pay zones, such gravel packs are often difficult to complete and may substantially increase the cost of well construction, particularly in Louisiana offshore completions at depths of, for example, 15,000 feet or less.

Another method which has been proposed for the control of sand production includes the use of plastic treatments which are designed to bind loose sand grains and/or an artificial filler material into a strong matrix, and yet leave the surrounding wellbore area permeable to oil or gas. Such treatments normally require the use of a large work-over rig which is needed to drill out excess plastic or plasticized material left inside the wellbore after the plastic matrix has set. It has also been suggested to use a pre-pack of resin coated sand which is catalysed after being pumped in place to produce sand packed perforations.

Additional systems for sand control which have been suggested include fracture packing with a tail-in of consolidated sand. This technique is described as having the advantage of correcting wellbore damage that may have been created by the completion or workover system. The consolidation of the high permeability frac sand with a strong bonding material leaves a high productivity in the wellbore.

For a general review of such offshore completion and workover procedures, please refer to "Recent Innovations In Offshore Completion and Workover Systems" by Rike, et al, 1969 Proceedings, Offshore Technology Conference; "Considerations in Gravel Pack Design", Saucier, Well Completions, Volume 2, No. 5A, published by the Society of Petroleum Engineers, Page 50–57; and "Pressure Packing With Concentrated Gravel Slurry", by Sparlin, Copyright 1972, American Institute of Mining, Metalurgical and Petroleum Engineers, Inc.

Another method which has been proposed to control sand production comprises injecting properly sized gravel which has been coated with a consolidating chemical (e.g. epoxy) into a cased and perforated wellbore. Slurry injection is stopped so that gravel is screened out on the formation and packed in the wellbore, covering the perforations and filling them with consolidating gravel. After this placement is accomplished, the well is shut in for a time to allow the gravel to consolidate. The final step in the process is to drill the consolidated gravel out of the wellbore and place the well in production. For a description of this method, please refer to "A Gravel-Coating Aqueous Epoxy Emulsion System For Water-Based Consolidated Gravel Packing: Development and Application" Knapp, et al, Well Completions, Volume 2, No. 5A, Published by the Society of Petroleum Engineers, Pages 76–83.

One problem which is not normally encountered in loosely or unconsolidated pay formations is the problem of poor pay zone permeability. Such a problem is often encountered in tight formations, that is, formations wherein the permeability of the pay zone is relatively low. In such highly consolidated pay zones, a number of well stimulating techniques have been employed which are intended to increase the production of the pay zone. These techniques generally involve either acidizing the pay zone, or fracturing the pay zone through any one of a number of fracturing techniques.

One technique which has been suggested for producing fractures in formations surrounding cased boreholes includes the forcing of fluids through perforations formed in such casings. For example, in U.S. Pat. No. 3,547,198 (Slusser) a method is disclosed for forming two vertically disposed fractures. These fractures communicate with a cased well which penetrates a subterranean earth formation having a known preferred fracture orientation. Openings are formed through the well on opposide sides of the casing. These openings are located such that they lie in a vertical plane which extends transversely of the fracture orientation. Hydraulic pressure is then applied through the openings to form a fracture at the openings on one side of the well. These openings are then temporarily sealed by ball sealers and hydraulic pressure is applied to form a fracture at the openings on the other side of the well. As explained in U.S. Pat. No. 3,547,198, it is known that the orientation of a fracture depends to some extent on the depth at which it is formed. Vertical fractures are generally preferentially formed at depths greater than about 2,000 to 3,000 feet.

Normal fracturing techniques include injecting a fracturing fluid ("frac fluid") under pressure into the surrounding formation, permitting the well to remain shut in long enough to allow decomposition or "breakback" of the crosslinked gel of the fracturing fluid, and removing the fracturing fluid to thereby stimulate production from the well. Such fracturing methods are effective at placing well sorted sand, such as 20–40 mesh, in vertically oriented fractures. After completion of the fracturing treatment, fracture closure due to compressive earth stresses holds the fracturing sand in place. Field experience has shown that there is little or no production of the fracturing sand back into the well after fracture closure, even with small earth stresses at shallow depths. Accordingly, hydraulic fracturing has become a well established method for stimulating oil and gas wells completed in hard, brittle formations.

SUMMARY OF THE INVENTION

The present invention relates to a novel method for controlling sand production in cased boreholes which collect fluid from unconsolidated or loosely consolidated pay zones. Such zones would otherwise be expected to produce substantial quantities of sand.

Generally, it has been found that loosely consolidated or unconsolidated pay zones, including those which are themselves mostly sand, will apply sufficient compressive stresses to retain fracturing sands which are properly introduced to create vertical, frac sand filled fractures.

In accordance with the preferred method of the present invention, a borehole casing is provided through an unconsolidated or poorly consolidated formation pay zone and is perforated at preselected intervals to form at least one set of vertical perforations. A high consistency index fracturing fluid containing a gravel pack sand is then pumped through those perforations at a rate which is sufficient to form a vertical fracture which exceeds the height and width of the aforementioned set of perforations at its point of juncture with the outside surface of the borehole casing. Such fracture is created by pumping this high consistency index fracturing fluid at the highest practical rate. Next, sand concentration in the high consistency index fracturing fluid is increased during pumping to approach sand out at shut-in. The well is then shut in to permit the fracturing fluid to decompose. Decomposition should be permitted to proceed to completion. If desired, breaker additives should be added to the fracturing fluid for the purpose of accelerating this decomposition process. The well is then flowed back slowly to reduce the well-head pressure to about the reservoir pressure, and production is gradually increased over a period of days to normal levels. In each of the above-described steps, care is taken to ensure that the fracturing sand will be deposited around the outer surface of the borehole casing so that it covers and overlaps each borehole casing perforation. More particularly, at the fracture-borehole casing interface, the sand fill will cover and exceed the width of the casing perforations, and cover and exceed the vertical height of each perforation set. Care is also exercised to ensure that the fracturing sand deposited as the sand fill within the vertical fracture does not wash out during the flow back and production steps.

Accordingly, a primary object of the present invention is the provision of an improved sand control method.

A further object of the present invention is the provision of a sand control method which does not require the provision of a conventional gravel pack.

A further object of the present invention is the provision of economical sand control measures which are useful in poorly consolidated or unconsolidated formations.

These, and others objects of the present invention will become apparent from the following more detailed description.

DESCRIPTION OF THE PREFERRED EMBODIMENTS

Figure 1:
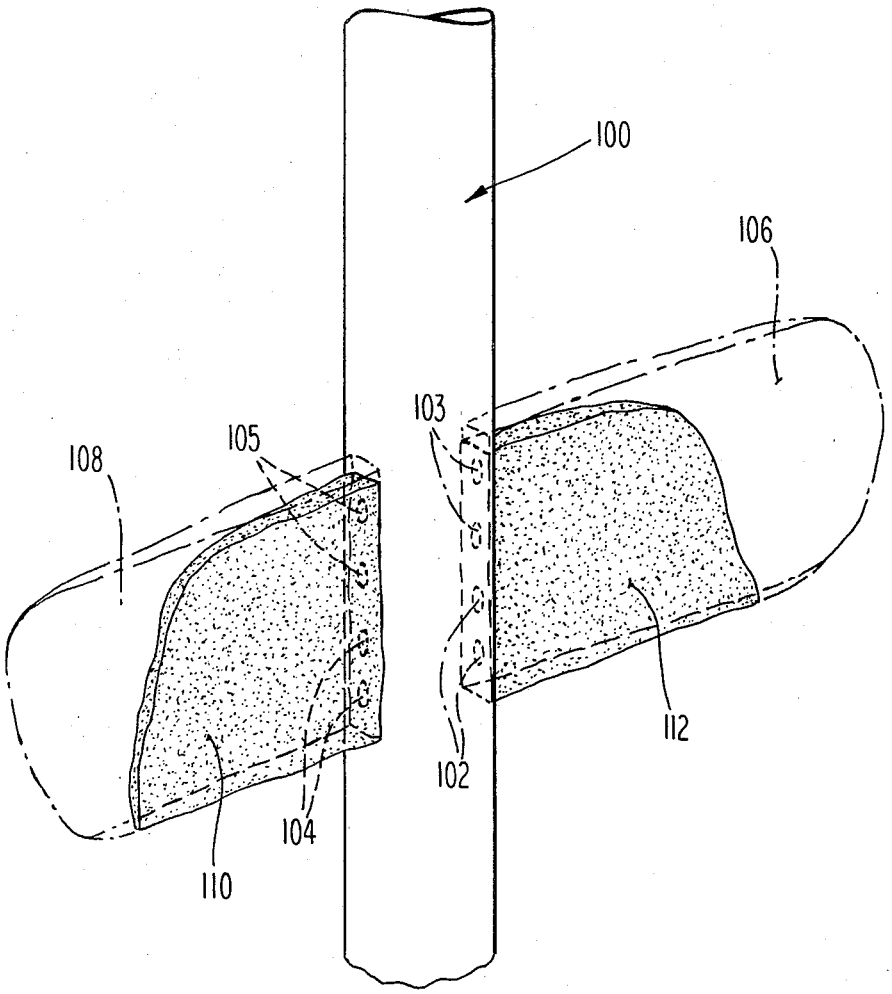
FIG. 1 is a diagrammatic view of a foreshortened, perforated borehole casing at a location within a loosely consolidated or unconsolidated formation, diagramatically illustrating two sets of vertical perforations, vertical fractures, and fracturing sand fills which have been created in accordance with the preferred method of the present invention.

Although specific examples have been selected for the purpose of illustrating the preferred methods of the present invention, those of ordinary skill in this art will recognize that various modifications to the techniques and apparatus of these methods may be made without departing from the scope of the present invention, which is defined more particularly in the claims which are appended hereto.

The present invention generally provides a novel sand control method for use in a borehole having a loosely consolidated or unconsolidated pay zone which is otherwise likely to introduce substantial amounts of pay sand into the borehole during oil or gas production. Accordingly, the method of the present invention is intended only for use in those pay zones where gravel packs or other sand control measures would otherwise have been necessary in order to control a sand production problem. The present invention is accordingly believed to be particularly useful in controlling sand production problems at various off-shore drilling locations, such as at off-shore Louisiana drilling sites, which are often characterized by pay zones of unconsolidated sands of the type described above.

In FIG. 1, a foreshortened borehole casing designated generally 100 is illustrated which is disposed within a loosely consolidated or unconsolidated formation (not illustrated in FIG. 1). The borehole casing 100 may be a conventional perforatable borehole casing such as for example, a cement sheathed, metal-lined borehole casing.

The next step in the performance of the preferred embodiment method, is the perforating of casing 100 to provide a plurality of perforations at preselected intervals therealong. Such perforations should, at each level, comprise two sets of perforations which are simultaneously formed on opposite sides of the borehole casing. In FIG. 1, the right hand set of perforations may be seen to comprise upper perforations 103 and lower perforations 102. The lefthand set of perforations will be seen to comprise lower perforations 104 and upper perforations 105. These perforations should have diameters between $\frac{1}{4}$ and $\frac{3}{8}$ of an inch, be placed in line, and be substantially parallel to the longitudinal axis of the borehole casing.

In order to produce the desired in-line perforation pattern shown in FIG. 1, a conventional perforation gun should be properly loaded and fired simultaneously to produce all of the perforations within the formation zone to be fractured. Proper alignment of the perforations should be achieved by equally spacing an appropriate number of charges on opposite sides of a single gun. The length of the gun should be equal to the thickness of the interval to be perforated. Azimuthal orientation of the charges at firing is not critical, since the initial fracture produced through the present method will leave the wellbore in the plane of the perforations. If this orientation is different from the preferred one, the fracture can be expected to bend smoothly into the preferred orientation within a few feet from the wellbore. This bending around of the fracture should not interfere with the characteristics of the completed well.

The next step in the preferred method is the pumping of a high consistency index fracturing fluid which contains a high concentration of sand of preselected diameters. In accordance with the present method, a conventional fracturing fluid having a fracturing fluid consistency of no less than 0.1 lb-sec$^n$/ft$^2$ is selected which is injected into the perforation at a rate of greater than 10 barrels per minute. The sand concentration within this fracturing fluid should be no less than 6 pounds per gallon (average). The preferred sand for use in the fracturing fluid of the present invention is the same sand which would have been selected, as described above, for constructing a gravel pack in the subject pay zone in accordance with prior art techniques. Normally, 20–40 mesh sand will be used, however, depending upon the nature of the particular formation to be subjected to the present treatment, 40–60 or 10–20 mesh sand may be used in the fracturing fluid.

It is preferred to pump the aforementioned high viscosity fracturing fluid at the highest practical rate to ensure that fractures are formed which are wide enough to exceed the diameter of the perforations in the borehole casing. Rates of less than 10 barrels per minute are not presently believed to provide sufficient fluid flow to ensure that such a width will be created. In FIG. 1, two fracture zones which have been created by pumping the aforementioned fracturing fluid-sand mixture are illustrated, a right-hand vertical fracture 106 which has been formed through perforations 102 and 103, and a left vertical fracture 108 which has been formed through perforations 104 and 105. At their termini against the outer surface of borehole casing 100, these fractures cover and substantially overlap each of the aforementioned perforations.

Once the aforementioned pumping rate has been obtained and the above-described vertical fractures formed, the sand concentration in the fracturing fluid should be gradually increased to approach sand-out at shut-in. By increasing the concentration of sand in the fracturing fluid, the amount of sand which will be deposited immediately adjacent to the borehole casing at shut-in will reach a practical maximum at the completion of this step of the process. The possibility of washout or settling which might subsequently uncover one or more of the borehole perforations is thus minimized.

Since it is important to ensure that the fracture height substantially exceeds the vertical height of each set of perforations, to allow for some settling without uncovering the perforations, it is desirable to select an interval thickness which is not too large. This ensures that the fracture height will at least slightly exceed the perforated interval height. The use of a high viscosity fracturing fluid pumped at a high rate also aids in ensuring that a fracture height will be obtained which will exceed the perforated interval height.

The next step in the preferred method is shutting-in the well to permit the fracturing fluid to decompose. Temperatures in the pay zone typically range from between 150°–300° F. Conventional fracturing fluids are designed to decompose at such temperatures, as for example through a temperature induced depolymerization. Such decomposition or "breakback" will normally occur within about 2–4 hours of the time of frac fluid injection. In order to ensure that such decomposition is complete after that period of time, appropriate "breaker" additives may be mixed with the frac fluid to assure complete decomposition of the frac fluid gel within a few hours.

Following frac fluid decomposition, the well should be flowed back slowly to reduce the well head pressure to about the reservoir pressure. This flowback process should be accomplished by maintaining a flow rate which does not exceed one barrel per minute until the aforementioned pressures are substantially equalized. Following flowback, production should be gradually increased while avoiding any sudden pressure changes for the first few days after fracturing. By following the above described techniques, it should be possible to assure that sand fills, such as sand fills 110 and 112 illustrated in FIG. 1, are formed which substantially cover and overlap both the top and sides of each perforation set. These techniques also assure that the sand fill above the topmost perforation is not washed out before complete fracture closure has occurred.

Since a certain amount of settling is inevitable in the sand fills, such as sand fills 110 and 112, the borehole casing interval to be perforated should be limited in length. It is currently anticipated that such lengths may not exceed 50 feet for each stage of fracturing. Care should then be taken to locate the next fracturing stage at a sufficient distance along the borehole casing so that no substantial interference will occur between one fracture stage and the next.

Once suitable sand fills are created on either side of the borehole, little or no trouble should be encountered with sand production, since sand which might otherwise enter the borehole will be filtered out by the sand fills 110 and 112, and over time, may even serve to stabilize the sand fill configurations.

As seen from the above, an extremely simple and efficient method is provided for controlling sand production in boreholes having loosely consolidated or unconsolidated pay zones. As such, the described method represents a substantial advance over those gravel pack methods heretofore known to the art.

What is claimed is:

1. A sand control method for use in a borehole having a loosely consolidated or unconsolidated pay zone which is otherwise likely to introduce substantial amounts of pay sand into the borehole, comprising the steps of:

(a) providing a borehole casing through said pay zone;

(b) perforating said casing at preselected intervals therealong to form at least one set of longitudinal, in-line perforations;

(c) pumping high consistency index fracturing fluid containing a gravel pack sand through said perforations at the highest practical rate to form a fracture height and width contiguous to said perforations which exceeds the height and width of said set of said perforations;

(d) gradually increasing the sand concentration during step (c) to approach sand-out at shut in;

(e) shutting in the well to permit said fracturing fluid to decompose;

(f) flowing the well back slowly to reduce the well head pressure to about the reservoir pressure; and (g) producing from the well at a gradually increasing production rate without any sudden pressure changes, said steps (c), (d), (e), (f) and (g) being performed in a manner which ensures that the sand fill of the fracture formed adjacent to said set of perforations exceeds the height and width of said set of perforations and is not washed out above the topmost perforation before fracture closure has occurred, whereby sand production from said pay zone is controlled.

2. The method of claim 1 wherein said set of perforations does not exceed a vertical length of 50 feet.

3. The method of claim 1 wherein said fracturing fluid has a consistency index of no less than 0.1 lb-sec$^n$/ft$^2$.

4. A sand control method for use in a borehole having a loosely consolidated or unconsolidated pay zone which is otherwise likely to introduce substantial amounts of pay sand into the borehole, comprising the steps of:

(a) providing a borehole casing through said pay zone, (b) perforating said casing on opposite sides with perforations not exceeding $\frac{3}{8}$ inch in diameter and located at preselected intervals not exceeding a total length of about 50 feet to form at least two sets of longitudinal, in-line perforations, (c) pumping a fracturing fluid having a consistency index of no less than 0.1 lb-sec$^n$/ft$^2$, and containing a gravel pack with a sand concentration of no less than 6 pounds per gallon through said perforations at a rate of no less than 10 barrels per minute to form a fracture height and width contiguous to said perforations which exceeds the height and width of said set of said perforations, (d) after the desired pumping rate has been reached and the vertical fractures are formed, gradually increasing the sand concentration in the fracturing fluid to approach sand-out at shut-in;

(e) shutting in the well to permit said fracturing fluid to decompose, and (f) flowing the well back slowly to reduce the well head pressure to about the reservoir pressure, and (g) producing from the well at a gradually increasing production rate without any sudden pressure changes, whereby the sand fill above the topmost perforation is not washed out and sand production from said pay zone is controlled.

* * * * *